US008287233B2

(12) United States Patent
Chen

(10) Patent No.: US 8,287,233 B2
(45) Date of Patent: Oct. 16, 2012

(54) CENTRIFUGAL COMPRESSOR WITH A RE-CIRCULATION VENTURI IN PORTED SHROUD

(75) Inventor: Hua Chen, Blackburn (GB)

(73) Assignee: Honeywell International Inc., Morristown, NJ (US)

( * ) Notice: Subject to any disclaimer, the term of this patent is extended or adjusted under 35 U.S.C. 154(b) by 1208 days.

(21) Appl. No.: 10/583,937

(22) PCT Filed: Dec. 24, 2003

(86) PCT No.: PCT/US03/41626

§ 371 (c)(1),
(2), (4) Date: Jul. 2, 2008

(87) PCT Pub. No.: WO2005/068842

PCT Pub. Date: Jul. 28, 2005

(65) Prior Publication Data

US 2008/0267765 A1 Oct. 30, 2008

(51) Int. Cl.
*F04D 29/44* (2006.01)

(52) U.S. Cl. ..... 415/58.4; 415/151; 415/206

(58) Field of Classification Search ..... 415/204, 415/205, 206, 58.4, 58.6, 149.1, 151
See application file for complete search history.

(56) References Cited

U.S. PATENT DOCUMENTS

| | | | | |
|---|---|---|---|---|
| 2,656,096 | A | 10/1953 | Scwarz | |
| 4,708,584 | A * | 11/1987 | Meng | 415/58.5 |
| 4,930,978 | A | 6/1990 | Khann et al. | |
| 5,863,178 | A * | 1/1999 | Scheinert et al. | 415/58.4 |
| 2002/0192073 | A1 | 12/2002 | Japikse | |

FOREIGN PATENT DOCUMENTS

| | | |
|---|---|---|
| GB | 897575 | 5/1962 |

OTHER PUBLICATIONS

ISR/WO, Sep. 15, 2004, Honeywell.

* cited by examiner

*Primary Examiner* — Ninh H Nguyen
(74) *Attorney, Agent, or Firm* — Brian Pangrle

(57) ABSTRACT

An exemplary port (180, 180') includes a first port opening (182, 182') positioned at a location downstream from a compressor wheel (140), a second port opening (184, 184') positioned at a location adjacent to a blade (144) of the compressor wheel (140), and a third port opening (186, 186') positioned at a location upstream from the compressor wheel (140) wherein the first port opening and the third port opening define a first flow path and wherein a second flow path extending from the second port opening meets the first flow path at a confluence (188, 188'). The first flow path optionally includes a venturi section, for example, wherein the confluence coincides at least in part with the venturi section. Other exemplary ports, compressor shrouds, systems and methods are also disclosed.

8 Claims, 11 Drawing Sheets

CENTRIFUGAL COMPRESSOR WITH A RE-CIRCULATION VENTURI IN PORTED SHROUD

TECHNICAL FIELD

This invention relates generally to methods, devices, and/or systems for compressors and, in particular, compressors for internal combustion engines.

BACKGROUND

A compressor flow map, e.g., a plot of pressure ratio versus mass air flow, can help characterize performance of a compressor. In a flow map, pressure ratio is typically defined as the air pressure at the compressor outlet divided by the air pressure at the compressor inlet. Mass air flow may be converted to a volumetric air flow through knowledge of air density or air pressure and air temperature. Compression causes friction between air molecules and hence frictional heating. Thus, air at a compressor outlet generally has a considerably higher temperature than air at a compressor inlet. Intercoolers act to remove heat from compressed air before the compressed air reaches one or more combustion chambers.

A typical compressor flow map usually indicates compressor efficiency. Compressor efficiency depends on various factors, including pressure, pressure ratio, temperature, temperature increase, compressor wheel rotational speed, etc. In general, a compressor should be operated at a high efficiency or at least within certain efficiency bounds. One operational bound is commonly referred to as a surge limit while another operational bound is commonly referred to as a choke area. Compressor efficiency drops significantly as conditions approach the surge limit or the choke area.

Choke area results from limitations associated with compressor wheel rotational speed and the speed of sound in air. In general, compressor efficiency falls rapidly as compressor wheel blade tips exceed the speed of sound in air. Thus, a choke area limit typically approximates a maximum mass air flow regardless of compressor efficiency or compressor pressure ratio.

A surge limit exists for most compressor wheel rotational speeds and defines an area on a compressor flow map wherein a low mass air flow and a high pressure ratio cannot be achieved. In other words, a surge limit represents a minimum mass air flow that can be maintained at a given compressor wheel rotational speed and a given pressure difference between the compressor inlet and outlet. In addition, compressor operation is typically unstable in this area. Surge may occur upon a build-up of back pressure at the compressor outlet, which can act to reduce mass air flow through the compressor. At worst, relief of back pressure through the compressor can cause a negative mass air flow, which has a high probability of stalling the compressor wheel. Some compressor systems use a bypass valve to help relieve such back pressure and thereby avoid any significant reduction of mass air flow through the compressor. Surge prevention can also reduce wear on a compressor and related parts.

Overall, surge of centrifugal compressors limits the useful operating range. Previous attempts to reduce surge limits for compressors have met with difficulties at low compressor wheel rotational speeds. For example, various previous attempts used a port between the compressor outlet and the compressor inlet to re-circulate some of the air mass when a build-up of back pressure occurred. However, such a port significantly reduced compressor efficiency.

Various previous attempts have also used a ported compressor wheel shroud (e.g., a shroud having a port) to reduce surge flow at higher compressor wheel rotational speeds, but at lower compressor wheel rotational speeds, the pressure difference between the port and the compressor inlet is typically very small and hence the port becomes fairly ineffective.

While previous attempts at re-circulation have proven less than ideal, especially at low compressor wheel rotational speeds, re-circulation remains as a viable means to improve compressor operation. In particular, as presented herein, various exemplary ports, systems and/or methods, rely on a specialized port to improve compressor operation at lower compressor wheel rotational speeds and/or at other operating conditions.

BRIEF DESCRIPTION OF THE DRAWINGS

A more complete understanding of the various method, systems and/or arrangements described herein, and equivalents thereof, may be had by reference to the following detailed description when taken in conjunction with the accompanying drawings wherein.

DETAILED DESCRIPTION

Various exemplary devices, systems and/or methods disclosed herein address issues related to compressors. For example, as described in more detail below, various exemplary devices, systems and/or methods address recirculation of gas proximate to a compressor.

Figure 1:
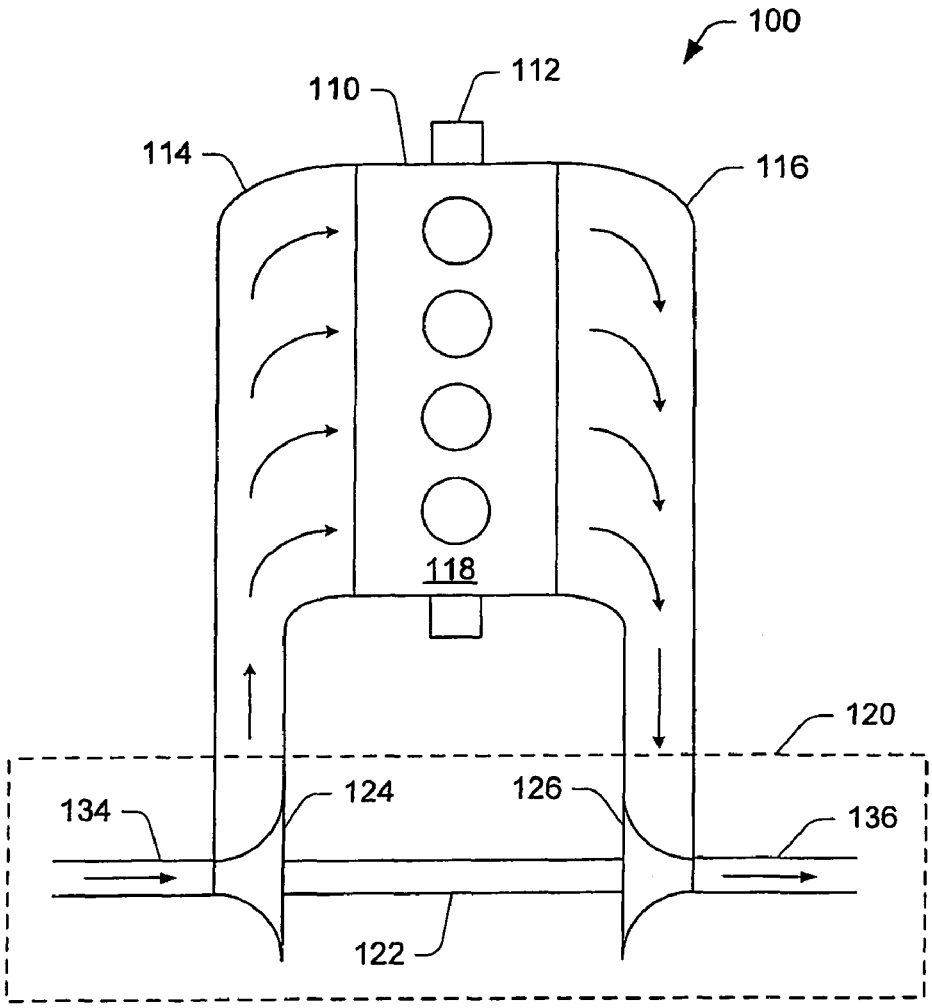
FIG. 1 is a simplified approximate diagram illustrating a turbocharger with a variable geometry mechanism and an internal combustion engine.

Turbochargers are frequently utilized to increase the output of an internal combustion engine. Referring to FIG. 1, an exemplary system 100, including an exemplary internal combustion engine 110 and an exemplary turbocharger 120, is shown. The internal combustion engine 110 includes an engine block 118 housing one or more combustion chambers that operatively drive a shaft 112. As shown in FIG. 1, an intake port 114 provides a flow path for air to the engine block while an exhaust port 116 provides a flow path for exhaust from the engine block 118.

The exemplary turbocharger 120 acts to extract energy from the exhaust and to provide energy to intake air, which may be combined with fuel to form combustion gas. As shown in FIG. 1, the turbocharger 120 includes an air inlet 134, a shaft 122, a compressor 124, a turbine 126, and an exhaust outlet 136. The turbine 126 optionally includes a variable geometry unit and a variable geometry controller. The variable geometry unit and variable geometry controller optionally include features such as those associated with commercially available variable geometry turbochargers (VGTs), such as, but not limited to, the GARRETT® VNT™ and AVNT™ turbochargers, which use multiple adjustable vanes to control the flow of exhaust across a turbine.

Adjustable vanes positioned at an inlet to a turbine typically operate to control flow of exhaust to the turbine. For example, GARRETT® VNT™ turbochargers adjust the exhaust flow at the inlet of a turbine rotor in order to optimize turbine power with the required load. Movement of vanes towards a closed position typically directs exhaust flow more tangentially to the turbine rotor, which, in turn, imparts more energy to the turbine and, consequently, increases compressor boost. Conversely, movement of vanes towards an open position typically directs exhaust flow in more radially to the turbine rotor, which, in turn, increase the mass flow of the turbine and, consequently, decreases the engine back pressure (exhaust pipe pressure). Thus, at low engine speed and small exhaust gas flow, a VGT turbocharger may increase turbine power and boost pressure; whereas, at full engine speed/load and high gas flow, a VGT turbocharger may help avoid turbocharger overspeed and help maintain a suitable or a required boost pressure.

A variety of control schemes exist for controlling geometry, for example, an actuator tied to compressor pressure may control geometry and/or an engine management system may control geometry using a vacuum actuator. Overall, a VGT may allow for boost pressure regulation which may effectively optimize power output, fuel efficiency, emissions, response, wear, etc. Of course, an exemplary turbocharger may employ wastegate technology as an alternative or in addition to aforementioned variable geometry technologies.

Figure 2:
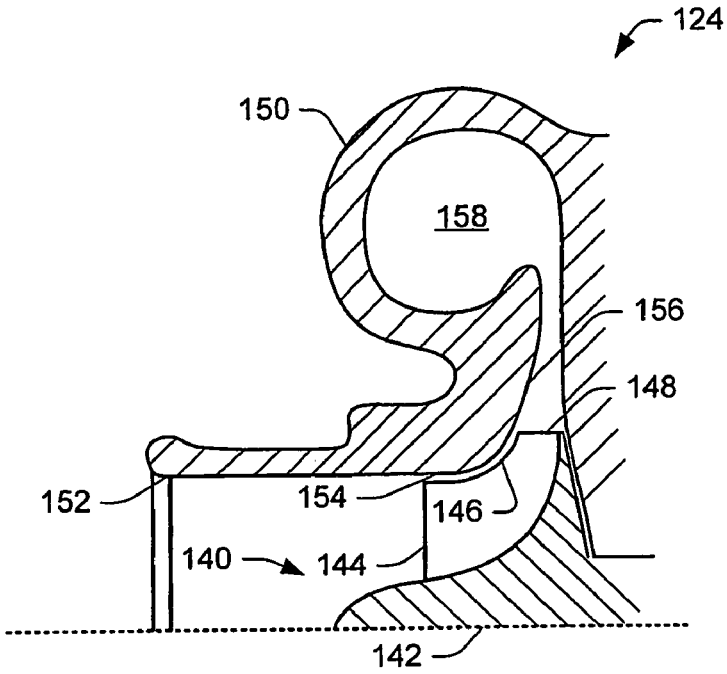
Fig. 2 (Prior Art)
FIG. 2 is a cross-sectional view of a prior art compressor assembly that includes a compressor shroud and a compressor wheel.

FIG. 2 shows a cross-sectional view of a typical prior art compressor assembly 124 suitable for use in the turbocharger system 120 of FIG. 1. The compressor assembly 124 includes a housing 150 for shrouding a compressor wheel 140. The compressor wheel 140 includes a rotor 142 that rotates about a central axis. Attached to the rotor 142, are a plurality of compressor wheel blades 144, which extend radially from a surface of the rotor. As shown, the compressor wheel blade 144 has a leading edge portion 144 proximate to a compressor inlet opening 152, an outer edge portion 146 proximate to a shroud wall 154 and a trailing edge portion 148 proximate to a compressor housing diffuser 156. The shroud wall 154, where proximate to the compressor wheel blade 144, defines a section sometimes referred to herein as a shroud of compressor volute housing 150. The compressor housing shroud wall after the wheel outlet 156 forms part of a compressor diffuser that further diffuses the flow and increases the static pressure. The housing scroll 158 acts to collect and direct compressed air. As mentioned in the Background section, a compressor acts to compress air provided at an inlet (e.g., the inlet defined by a wall of the housing 152) and an outlet (e.g., an outlet defined by a scroll of the housing 158). Various examples presented herein refer to conditions at or near the compressor diffuser 156, which may be considered upstream from the outlet defined by the scroll 158, as well as at or near the outlet of the compressor.

Figure 3:
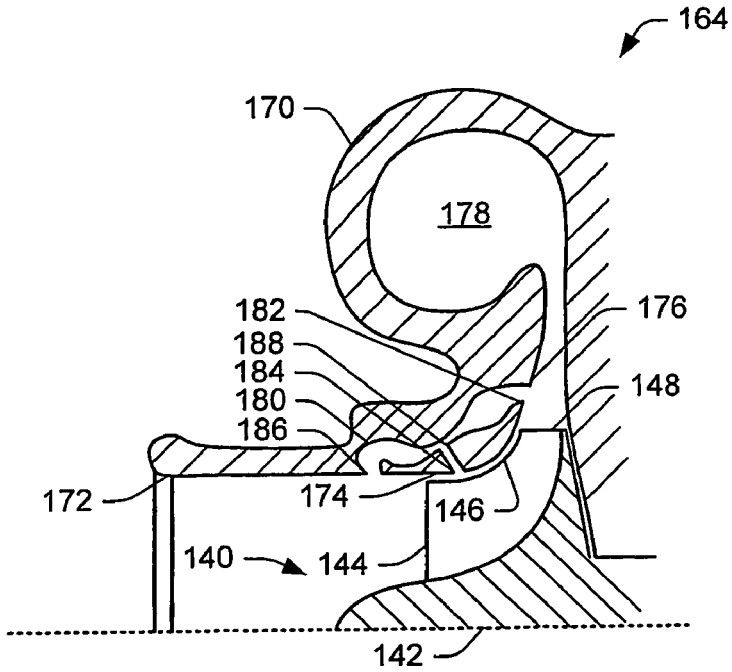
FIG. 3 is a cross-section view of an exemplary compressor system that includes an exemplary compressor shroud having an exemplary port.

FIG. 3 shows an exemplary compressor system 164 that includes an exemplary compressor housing 170. The exemplary system 164 is suitable for use in the turbocharger system 120 of FIG. 1 (e.g., as a replacement for the compressor 124). The compressor system 164 includes the exemplary housing 170 for shrouding a compressor wheel 140. The compressor wheel 140 includes a rotor 142 that rotates about a central axis. Attached to the rotor 142, are a plurality of compressor wheel blades 144, which extend radially from a surface of the rotor. As shown, the compressor wheel blade 144 has an leading edge portion 144 proximate to a compressor housing inlet opening 172, an outer edge portion 146 proximate to a shroud wall 174 and a trailing edge portion 148 proximate to a compressor housing diffuser 176. The shroud wall 174, where proximate to the compressor wheel blade 144, defines a section sometimes referred to herein as a shroud of the compressor volute housing 170. The diffuser 176 forms part of a housing scroll 178, which acts to collect and direct compressed air.

The exemplary housing 170 further includes a port 180. In this example, the port 180 includes a first port opening 182 proximate to the compressor diffuser 176, a second port opening 184 proximate to the shroud wall 174 and a third port opening 186 proximate to the housing inlet opening 172. The port 180 also includes a confluence 188 where a path from the second port opening 184 joins a path that connects the first port opening 182 and the third port opening 186. With respect to radial position, the first port opening 182 has a more distant radial position when compare to the radial positions of the second port opening 184 and the third port opening 186. With respect to axial positions from the housing inlet opening 172, the third port opening 186 is more proximate to the inlet opening 172 while the first port opening 182 is more distal to the inlet opening 172. The second port opening 184 generally lies at an axial position between that of the first port opening 182 and the third port opening 186. The paths optionally have circular, elliptical, polygonal and/or other cross-section. Cross-sections along the paths may vary. An exemplary shroud may include one or more such ports.

Thus, as described and shown, the exemplary compressor housing 170 includes an exemplary port 180 that includes a first port opening 182 positioned at a location downstream from a compressor wheel, a second port opening 184 positioned at a location adjacent to a blade of the compressor wheel (e.g., radially adjacent), and a third port opening 186 positioned at a location upstream from the compressor wheel wherein the first port opening and the third port opening define a first flow path and wherein a second flow path extending from the second port opening meets the first flow path at a confluence 188.

In this example, the port 180 has a narrow cross-section at the confluence 188. The narrow cross-section acts as a venturi in that velocity of gas flowing along the path between the first port opening 182 and the third port opening 186 will increase as it enters the venturi and/or decrease as it exits the venturi. Of course, an increase and/or a decrease in velocity will depend on various other factors including, but not limited to: pressure, volume and/or temperature of gas at the first, second and/or third openings 182, 184, 186; cross-sectional area of any of the port paths; and/or compressor wheel rotational speed.

During operation of the exemplary compressor system 164, the port 180 can allow for re-circulation of gas from a point downstream from the compressor wheel 140 to a point upstream from the compressor wheel 140. Where the port 180 includes a venturi, the pressure at the confluence 188 becomes less than the pressure at the second port opening 184. Due to this pressure differential, gas at the shroud section of the compressor volute housing (e.g., the shroud section adjacent to blades 144 of the compressor wheel 140) can enter the port 180 via the second port opening 184. In this example, the gas that forms the end wall boundary-layer near and at the shroud wall 174 (e.g., adjacent to the compressor wheel) is sucked thru the second port opening 184. This gas combines with gas that enters via the first port opening 182 and together the combined flow of gas exits via the third port opening 186.

In this example, the static pressure difference between the second port opening 184 at the shroud of the compressor volute housing (e.g., the shroud section adjacent to blades 144 of the compressor wheel 140) and the throat of the venturi (e.g., at, including, and/or proximate to the confluence 188), improves the effectiveness of a ported shroud at lower compressor speeds. The improved effectiveness, in turn, improves the internal flow of the compressor wheel, which leads to improvement of compressor efficiency and reduction of the surge flow at such compressor wheel rotational speeds. Overall, an improved efficiency and/or a relocation of surge limits exist where a compressor system includes such an exemplary port. While FIG. 3 shows the exemplary port 180 as being defined by the housing 170, alternative exemplary ports optionally include conduits that extend from and/or connect to housing. Hence, as described herein, an exemplary port optionally exists as wholly integrated in a compressor housing or shroud, partially integrated in a compressor housing and/or connected to a compressor housing.

Figure 4:
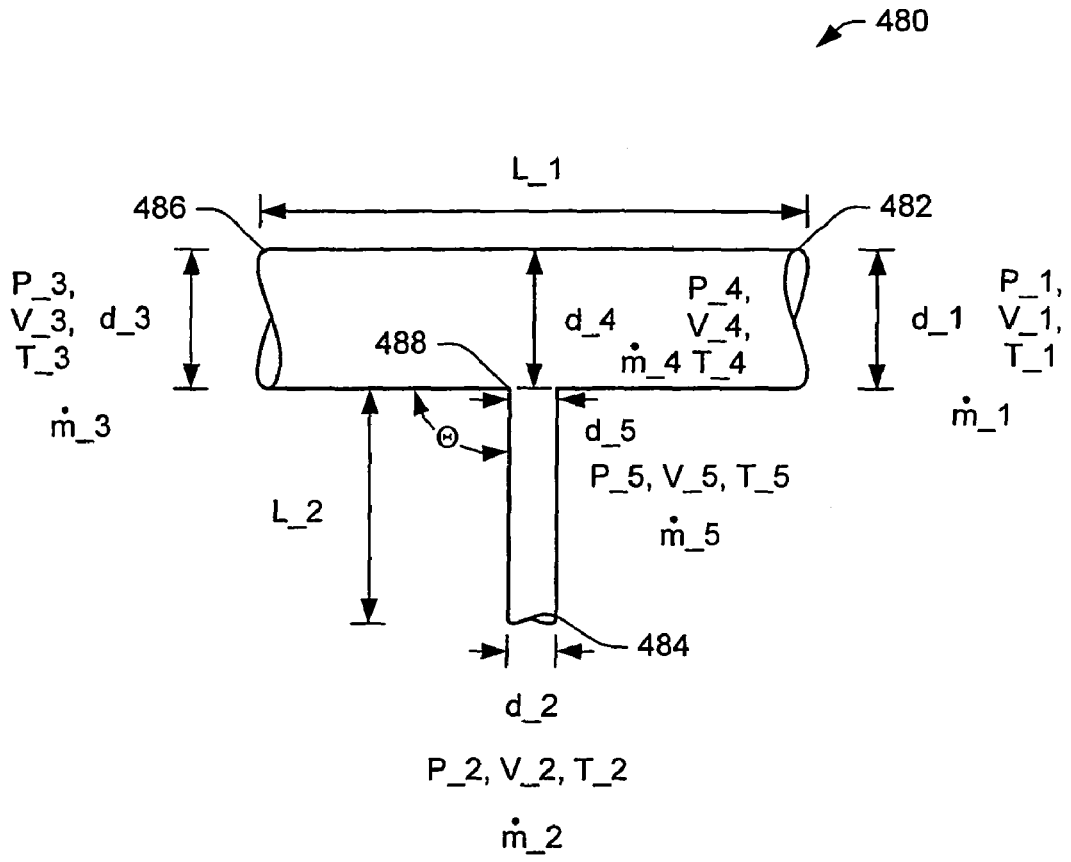
FIG. 4 is a diagram of an exemplary port.

FIG. 4 shows a diagram of an exemplary port 480. While the exemplary port 480 has substantially circular cross-sections along substantially linear axes, other non-circular cross-sections are possible as well as non-linear axes. In this example, the exemplary port 480 includes a first port opening 482 having a diameter d_1, a second port opening 484 having a diameter d_2, and a third port opening 486 having a diameter d_3. The port 480 also has an opening 488 at a confluence having a diameter d_5 and that joins a path having a diameter d_4. The path between the first port opening 482 and the third port opening 486 has a path length of L_1 while the path between the confluence 488 and the second port opening 484 has a path length of L_2. While various openings appear parallel or orthogonal, other arrangements are possible, for example, such as those of the exemplary port 180 of FIG. 3. Further, one or more paths may include bends or other deviations. Yet further, the path having length L_2 may form an angle Θ with the path having length L_1, for example, at or near the confluence 488. An angle greater than 90° may facilitate flow (e.g., reduce losses) at the confluence 488 where gas flows from the first port opening 482 to the third port opening 486.

Gas conditions exist at the first opening 482 including gas pressure (P_1), gas volume (V_1), gas temperature (T_1) and gas mass flow rate ($\dot{m}$_1); at the second opening 484 including gas pressure (P_2), gas volume (V_2), gas temperature (T_2) and gas mass flow rate ($\dot{m}$_2); at the third opening 486 including gas pressure (P_3), gas volume (V_3), gas temperature (T_3) and gas mass flow rate ($\dot{m}$_3); and at the confluence 488 for gas in a main path including gas pressure (P_4), gas volume (V_4), gas temperature (T_4) and gas mass flow rate ($\dot{m}$_4) and for gas in a secondary path including gas pressure (P_5), gas volume (V_5), gas temperature (T_5) and gas mass flow rate ($\dot{m}$_5). According to conservation of mass or continuity equation, the mass flow rate ($\dot{m}$_3) at the third port opening 486 must equal the sum of the mass flow rate ($\dot{m}$_1) at the first port opening 482 and the mass flow rate ($\dot{m}$_2) at the second port opening 484 (e.g., $\dot{m}$_3=$\dot{m}$_1+$\dot{m}$_2). While mass is conserved, changes in gas density, gas pressure, gas volume and gas temperature may occur along various paths of the exemplary port 480.

In the exemplary port 480, the diameters d_1, d_4 and d_3 are approximately equal. Thus, the exemplary port 480 has a substantially constant cross-section along a path from the first port opening 482 to the third port opening 486. While the exemplary port 180 includes a narrow section that acts as a venturi, the exemplary port 480 does not. However, the exemplary port 480 may still act to draw gas from the second port opening 484 where the mass flow of gas along the path from the first port opening 482 to the third port opening 486 is great enough to reduce the pressure at the confluence 488 below that at the shroud wall adjacent the compressor wheel.

The exemplary port 480 also serves to illustrate pressure drop along the path between the first port opening 482 and the third port opening 486. In general, pressure drop along a pipe decreases in a substantially linear manner from inlet to outlet; thus, the confluence 488 may be positioned closer to the third port opening 486 if a lower pressure is desired or closer to the first port opening 482 if a higher pressure is desired. Of course, one or more variations in cross-section (e.g., the venturi of the exemplary port 180) along a path may be used to further control pressure with respect to a confluence (e.g., the point 188, 488, etc.).

Figure 5:
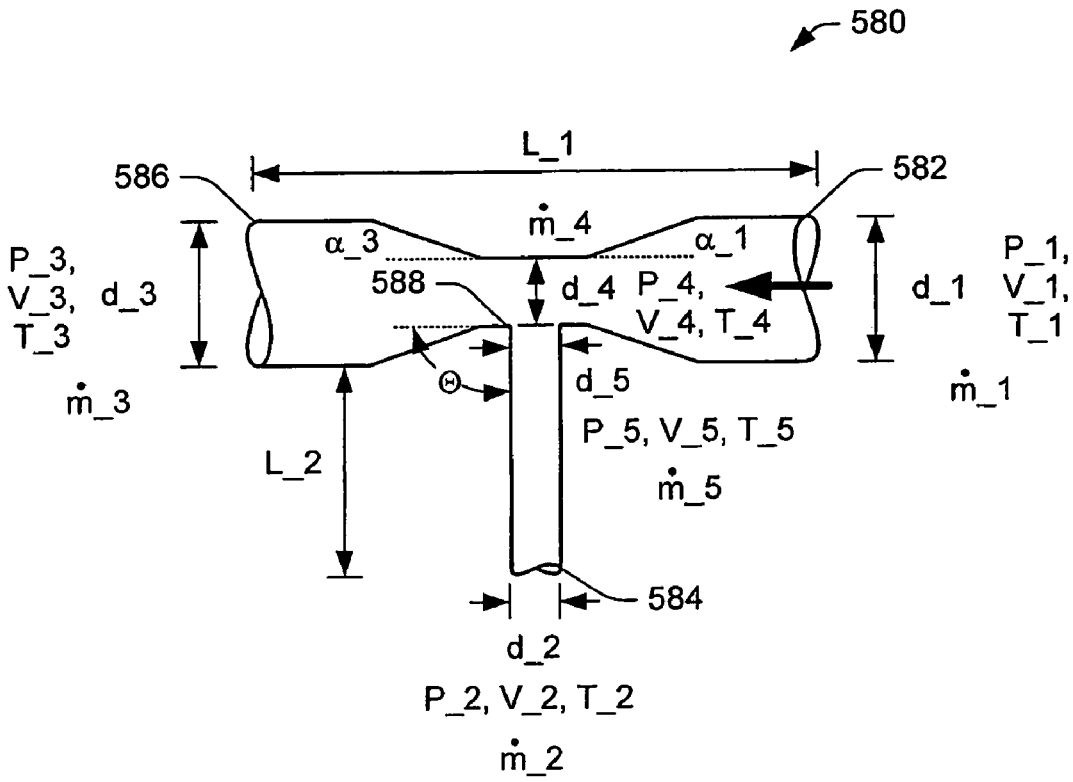
FIG. 5 is a diagram of an exemplary port that includes a venturi section.

FIG. 5 shows a diagram of an exemplary port 580. While the exemplary port 580 has substantially circular cross-sections along substantially linear axes, other non-circular cross-sections are possible as well as non-linear axes. In this example, the exemplary port 580 includes a first port opening 582 having a diameter d_1, a second port opening 584 having a diameter d_2, and a third port opening 586 having a diameter d_3. The port 580 also has an opening 588 at a confluence having a diameter d_5 and that joins a path having a diameter d_4. The path between the first port opening 582 and the third port opening 586 has a path length of L_1 while the path between the confluence 588 and the second port opening 584 has a path length of L_2.

While various openings appear parallel or orthogonal, other arrangements are possible, for example, such as those of the exemplary port 180 of FIG. 3. Further, one or more paths may include bends or other deviations. Yet further, the path having length L_2 may form an angle Θ with the path having length L_1, for example, at or near the confluence 588. An angle greater than 90° may facilitate flow (e.g., reduce losses) at the confluence 588 where gas flows from the first port opening 582 to the third port opening 586. The lengths of one or more paths are optionally chosen to minimize pressure loss along a path. For example, by keeping the path having length L_2 less than a predetermined length (e.g., for a given cross-sectional area, etc.), the exemplary port 580 may minimize pressure loss along the path and maximize the effect of the pressure differential between the second port opening 584 and the confluence 588. With respect to various condition terms, the pressure loss along the path having length L_2 may be represented as $\Delta P_{L_2}$=P_2−P_5. A limiting design or operational condition may be represented as P_2−P_4>$\Delta P_{L_2}$ or simply P_4<P_5.

The exemplary port 580 includes a venturi section (e.g., a throat section) positioned between the first port opening 582 and the third port opening 586. In general, a venturi refers to a conduit having a restricted section, for example, a section having a cross-sectional area that is less than a cross-sectional area of an upstream section of the conduit. In this example, the venturi section has a characteristic inner diameter d_4, which is smaller than a characteristic inner diameter upstream from the venturi section toward the first port opening 582 (e.g., d_4<d_1). The venturi section also at least partially coincides with the confluence 588. The venturi section has an associated pressure loss; hence, the increase in axial gas velocity comes at a cost (consider, e.g., a venturi coefficient). While such a pressure loss acts to reduce the effect of the pressure differential between the first port opening 582 and the third port opening 586, it is typically relatively insignificant and can be compensated for in terms of design and/or operation. As described herein, a venturi section can decrease pressure via an increase in gas velocity to thereby suck or promote gas flow from a region proximate to a compressor wheel and, in particular, from a boundary layer along a shroud wall adjacent to a compressor wheel.

The venturi section of the exemplary port 580 includes angles α_1 and α_3. In a traditional venturi meter, the upstream angle (e.g., α_1) is greater than the downstream angle (e.g., α_3) to reduce downstream pressure losses and the length of the upstream cone is typically shorter than that of the downstream cone. Upstream angles of approximately 15° to approximately 20° are found in traditional venturi meters while downstream angles may be approximately one-fourth to approximately one-third an upstream angle (e.g., approximately 5° to approximately 7°). The exemplary port 580 optionally includes a venturi section having an upstream angle (e.g., α_1) of approximately 15° to approximately 20° and/or a downstream angle (e.g., α_3) of approximately 5° to approximately 7° and/or a downstream angle (e.g., α_3) of approximately one-fourth to approximately one-third an upstream angle (e.g., α_1).

Gas conditions exist at the first opening 582 including gas pressure (P_1), gas volume (V_1), gas temperature (T_1) and gas mass flow rate (ṁ_1); at the second opening 584 including gas pressure (P_2), gas volume (V_2), gas temperature (T_2) and gas mass flow rate (ṁ_2); at the third opening 586 including gas pressure (P_3), gas volume (V_3), gas temperature (T_3) and gas mass flow rate (ṁ_3); and at the confluence 588 for gas in a main path including gas pressure (P_4), gas volume (V_4), gas temperature (T_4) and gas mass flow rate (ṁ_4) and for gas in a secondary path including gas pressure (P_5), gas volume (V_5), gas temperature (T_5) and gas mass flow rate (ṁ_5).

According to conservation of mass or continuity equation, the mass flow rate (ṁ_3) at the third port opening 586 must equal the sum of the mass flow rate (ṁ_1) at the first port opening 582 and the mass flow rate (ṁ_2) at the second port opening 584 (e.g., ṁ_3=ṁ×_1+ṁ_2). While mass is conserved, changes in gas density, gas pressure, gas volume and gas temperature may occur along various paths of the exemplary port 580. In particular, gas entering at the first port opening 582 is likely to have a higher temperature (e.g., T_1) than gas entering at the second port opening 584 (e.g., T_2) and gas entering at a housing inlet opening. Thus, gas exiting the port at the third port opening 586 is likely to have a temperature (e.g., T_3) greater than the temperature of the gas entering a compressor system at a housing inlet opening. In general, an increase in gas inlet temperature may act to decrease compressor efficiency. Thus, an exemplary system includes temperature monitoring to compensate for any increase in inlet temperature due to introduction of re-circulation gas (e.g., gas entering at a first port opening and/or at a second port opening).

If the amount of the gas re-circulated is above a certain flow rate and a certain energy level (e.g., temperature, etc.), a compressor wheel may experience heating that can reduce material strength, which can lead to failure of the compressor wheel, for example, if the compressor is operated speeds that are likely to induce significant stress and/or strain. In one example, the use of an exemplary port that re-circulates at least some gas from a lower temperature region, can reduce risk of compressor wheel overheating, especially when compared to re-circulation schemes that cannot re-circulate gas from a lower temperature region.

Various gas conditions are optionally calculated using the Bernoulli equation and/or a continuity equation. In certain instances, equations for incompressible fluids may suffice (e.g., wherein an error limit is known and/or tolerable); whereas, in other instances, gas compressibility may be taken into consideration.

Figure 6:
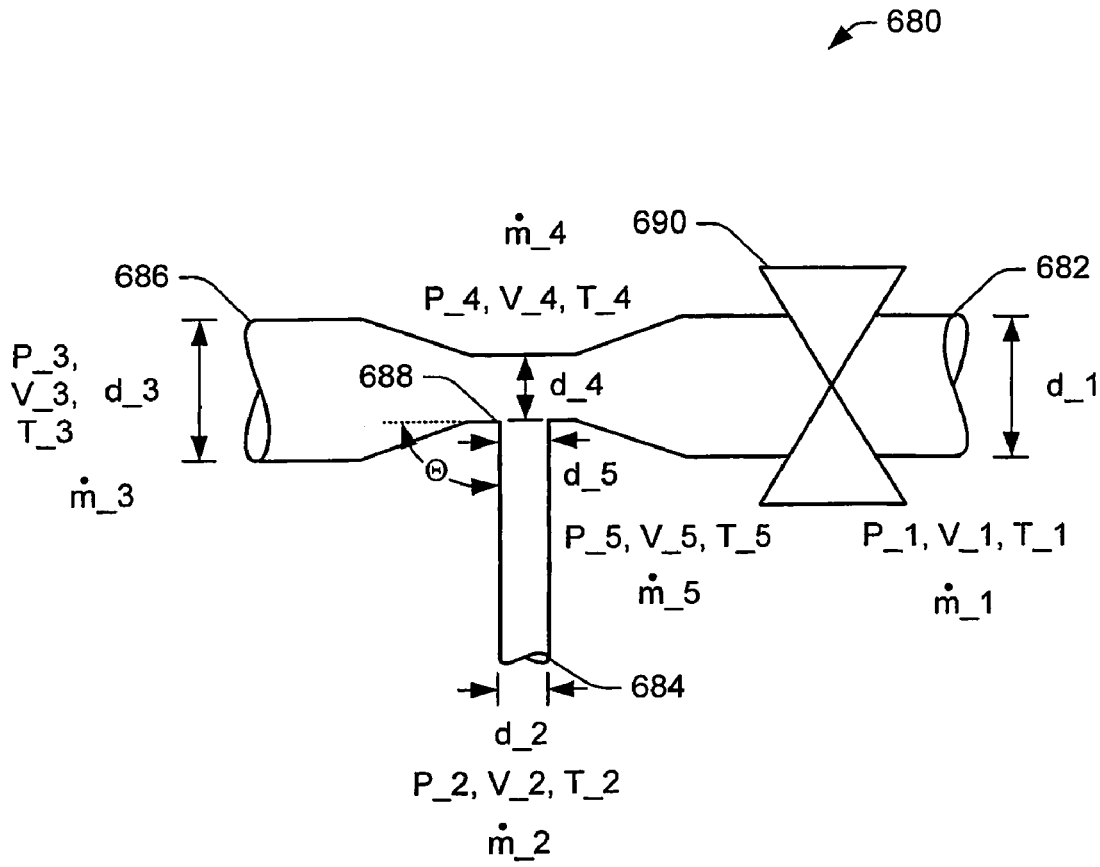
FIG. 6 is a diagram of another exemplary port that includes a valve.

FIG. 6 shows a diagram of an exemplary port 680 that includes one adjustable valve 690. Various conditions at various points are also shown. Descriptions of such conditions may be found in the descriptions of other figures (e.g., FIGS. 3-5). In the exemplary port 680, the valve 690 allows for direct regulation of flow along the path between the first port opening 682 and the third port opening 686 and indirect regulation of flow along the path between the second port opening 684 and the third port opening 686. For example, with the valve 690 closed, a flow path exists between the second port opening 684 and the third port opening 686. Flow along this path exists where the pressure (P_2) at the second port opening 684 is greater than the pressure (P_3) at the third port opening 686, assuming a correction for certain pressure losses along the path. Note that when the valve 690 is closed, the venturi section does not act to reduce pressure (e.g., P_4) at the confluence 688.

Regulation of such a valve may occur according to a pressure ratio. For example, as discussed in the Background section, a pressure ratio may be defined as a compressor outlet pressure divided by a compressor inlet pressure. With respect to the exemplary port 680, the valve 690 may be closed at a target pressure ratio. For example, when the pressure ratio reaches 1.8, a pressure triggered valve or some other mechanism may act to prevent gas from entering the first port opening 682. Adjustment of the valve 690 may occur in response to compressor wheel rotational speed, turbocharger system inertia, temperature, pressure and/or other factors: For example, if the pressure ratio is less than or equal to a target ratio and the rotational speed is less than or equal to a target speed, then the valve 690 may remain open; whereas, if the pressure ratio is above the target ratio or if the rotational speed is greater than the target speed, then the valve 690 may close. In general, where rotational speed is higher, compressor wheel inertia (and/or other component inertia) is higher and hence, the compressor wheel is less likely to lose speed or, in other words, a higher back pressure is required to have a significant detrimental effect on compressor wheel dynamics.

Figure 7:
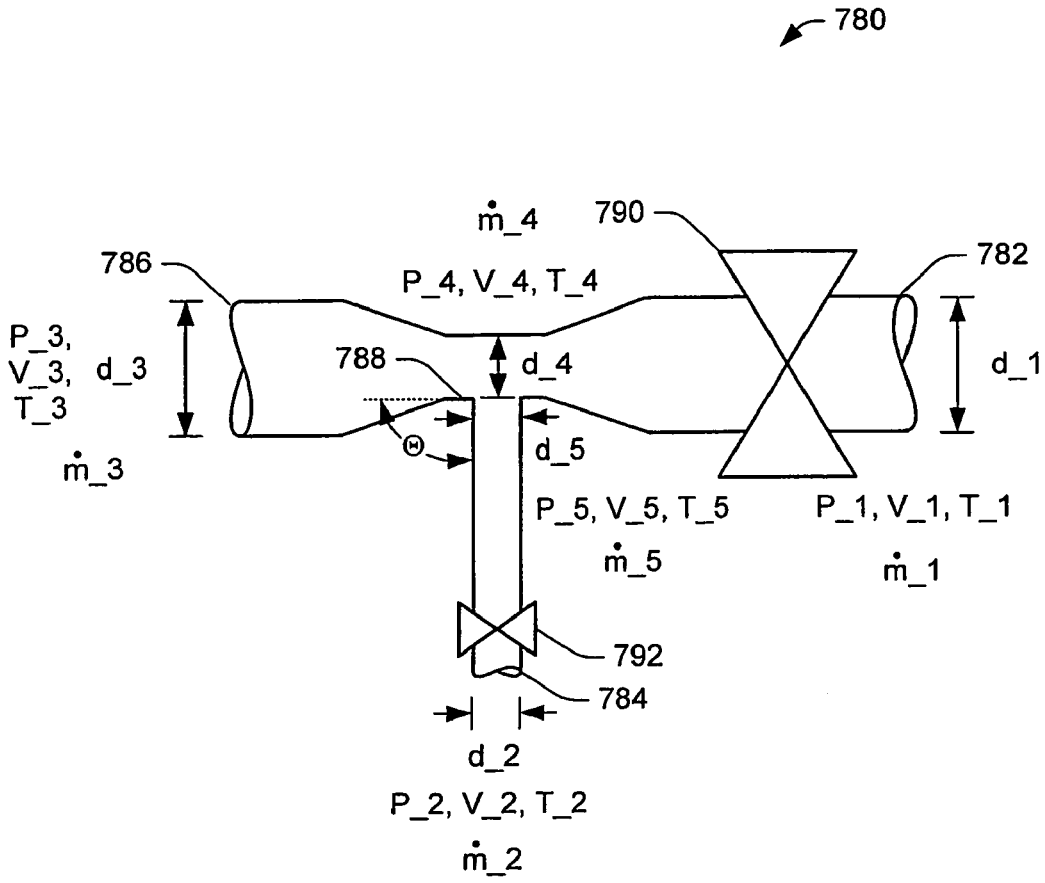
FIG. 7 is a diagram of another exemplary port that include more than one valve.

FIG. 7 shows a diagram of an exemplary port 780 that includes a plurality of valves and, in particular, a first valve 790 and a second valve 792. The first valve 790 optionally operates in a manner akin to the valve 690 of the exemplary port 680; however, with the introduction of another valve (e.g., the valve 792, etc.), additional control scenarios exist. Of course, in yet another exemplary port, one or more valves may be positioned at the same and/or at other locations to adjust flow along one or more paths of a port.

With respect to control scenarios, with binary state valves (e.g., "opened" or "closed"), four states exist: (i) both valves 790, 792 open; (ii) the valve 792 open and the valve 790 closed; (iii) the valve 790 open and the valve 792 closed; (iv) both valves 790, 792 closed. The first two states or analogues thereof have been discussed with reference to exemplary ports 180, 480, 580, 680 of FIGS. 3-6. The last two states offer opportunities for enhanced control of re-circulation gas. For example, scenario (iii) prevents gas from entering the second port opening 784. Such a scenario may exist for a predetermined pressure differential between a downstream port opening and an upstream port opening. The scenario (iv) ensures that no re-circulation occurs. Such a scenario may exist where there is little risk of approaching or exceeding a surge limit. Thus, scenario (iv) may be implemented where a compressor operates at conditions sufficiently removed from a surge limit. This can reduce any noise that may associate with the gas re-circulation.

Figure 8:
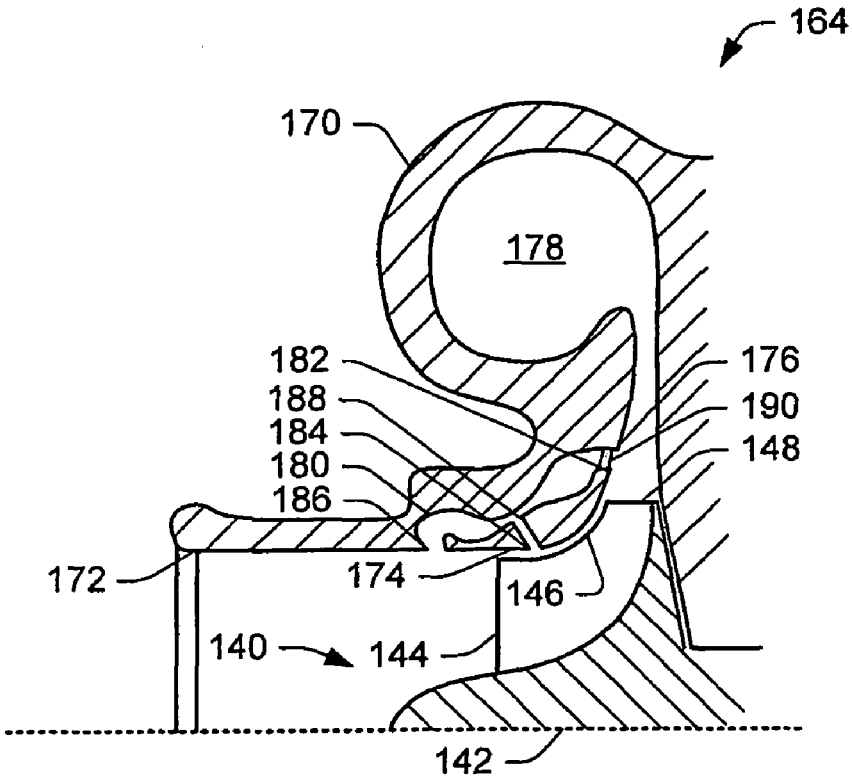
FIG. 8 is a cross-sectional view of a compressor system that includes an exemplary compressor shroud and a valve positioned to control flow in an exemplary port.

FIG. 8 shows a cross-sectional view of the compressor system 164 of FIG. 3; however, a valve 190 is also included. In this example, the exemplary port 180 includes the valve 190 proximate to the first port opening 182. Of course, one or more other valves may be positioned at other location to control flow of gas through the port 180. Such a valve can be integrated into the compressor housing, similar to those used in turbocharger compressors for gasoline engine turbocharging, but with different flow passage area schedule to form a venturi and connecting to the ported shroud 184.

Figure 9:
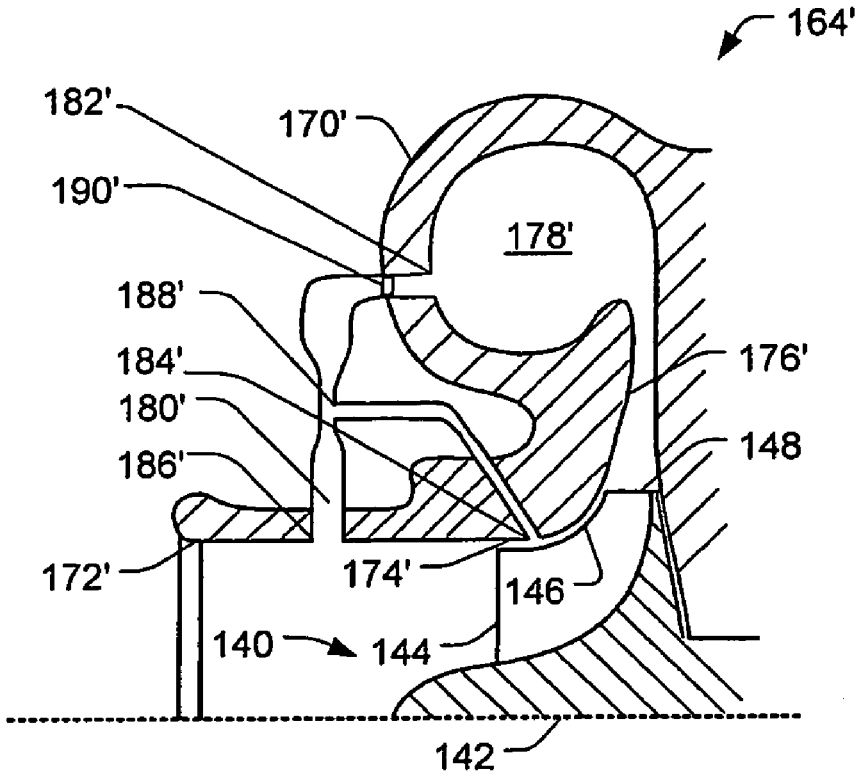
FIG. 9 is a cross-sectional view of a compressor system that includes an exemplary port that includes one or more flow paths (or sections) that lie at least partially external to a wall of a compressor shroud.

FIG. 9 shows a cross-sectional view of an exemplary compressor system 164' that includes a port 180' that extends at least partially from a compressor housing 170'. The exemplary system 164' is suitable for use in the turbocharger system 120 of FIG. 1 (e.g., as a replacement for the compressor 124). In this example, the exemplary port 180' includes a valve 190' positioned in a section of the port 180' proximate to an external surface boundary of the compressor housing 170'. Of course, one or more other valves may be positioned at one or more other locations to control flow of gas through the port 180'. Such a valve is optionally integrated into an external portion of the port 180', for example, as an in-line valve or as a valve that connects two flow portions of a port. Of course, such a valve may be positioned at least partially in a wall of a compressor housing.

In this example, compressed gas may be directed or re-circulated from a discharge region or section (e.g., region 178) of the compressor housing (e.g., the opening 182') to a region fore of a compressor wheel. Such an arrangement may facilitate introduction, positioning and/or operation of a valve. Of course, in another example, a port may include a port opening at a discharge region and yet another port opening at or proximate to a compressor diffuser section with or without valves for control of flow. Thus, an exemplary port may include one or more additional openings (e.g., a fourth opening, etc.) that may create one or more additional and/or optional flow paths. In another example, the exemplary port 180' is introduced as an add-on or replacement to a ported shroud compressor, of course, other exemplary ports may also be suitable, with or without one or more venturi sections, etc.

As shown, a compressor wheel blade 144 has an leading edge portion 144 proximate to a compressor housing inlet opening 172', an outer edge portion 146 proximate to a shroud wall 174' and a trailing edge portion 148 proximate to a compressor housing diffuser 176'. The shroud wall 174', where proximate to the compressor wheel blade 144, defines a section sometimes referred to herein as a shroud of the compressor volute housing 170'. The diffuser 176' forms part of a housing scroll 178', which acts to collect and direct compressed air.

In this example, the port 180' extends into the housing 170' and includes a first port opening 182' that connects to the compressor housing 170' and/or passes through a wall of the compressor housing 170', a second port opening 184' proximate to the shroud wall 174' and a third port opening 186' proximate to the housing inlet opening 172'. The port 180' also includes a confluence 188' where a path from the second port opening 184' joins a path that connects the first port opening 182' and the third port opening 186'. In this example, the confluence 188 lies in a region outside the wall of the housing 170'; however, in alternative examples, a confluence may lie at least partially in a wall of a compressor housing. For example, an outer wall of a housing may have one or more contours that form part of a confluence or other flow path of a port and/or support a conduit that acts as a flow path of a port. A venturi throat typically coincides with or includes a confluence.

With respect to radial position, the first port opening 182' has a more distant radial position when compare to the radial positions of the second port opening 184' and the third port opening 186'. With respect to axial positions from the housing inlet opening 172', the third port opening 186' is more proximate to the inlet opening 172' while the second port opening 184' is more distal to the inlet opening 172'. Note that the axial position of the first port opening 182' may be more proximate, of equal proximity or less proximate to the inlet opening 172' when compared to the second port opening 184' and/or the third port opening 186'. The paths optionally have circular, elliptical, polygonal and/or other cross-section. Cross-sections along the paths may vary. A housing may include one or more such ports, including a variety of different ports.

Thus, as described and shown, the exemplary compressor housing 170' includes an exemplary port 180' that extends at least partially from an outer surface of the housing 170'. The port 180' includes a first port opening 182' positioned at a location downstream from a compressor wheel, optionally at or proximate to a compressor housing discharge section, a second port opening 184' positioned at a location adjacent to a blade of the compressor wheel (e.g., radially adjacent), and a third port opening 186' positioned at a location upstream from the compressor wheel wherein the first port opening and the third port opening define a first flow path and wherein a second flow path extending from the second port opening meets the first flow path at a confluence 188' (e.g., optionally at or proximate to a venturi throat).

Various exemplary ports optionally include one or more venturi sections. Further, a venturi section may have any of a variety of arrangements. For example, a venturi section may receive flow via one or more flow paths that form one or more confluences with one or more other flow paths. While an exemplary port typically has one downstream opening positioned upstream of a compressor wheel, other exemplary ports optionally include a plurality of downstream openings. An exemplary port includes a confluence and optionally a venturi section, for example, wherein the venturi section coincides with or is proximate to the confluence.

Figure 10:
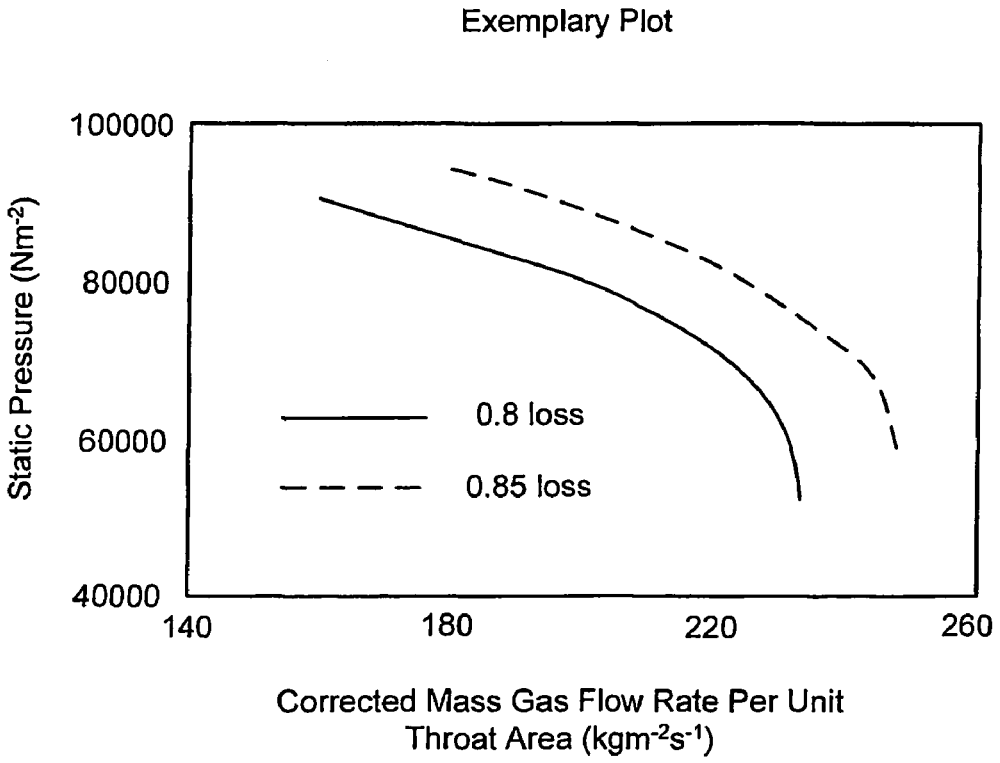
FIG. 10 is an exemplary plot of pressure versus flow.

FIG. 10 shows a plot of venturi section static pressure ($Nm^{-2}$) versus corrected mass gas flow rate per unit throat area ($kgm^{-2}s^{-1}$) for a compressor exit total pressure of 1.3 bar. The dashed line represents a total pressure loss of approximately 0.85 defined as total pressure at the throat of the venturi section divided by the total pressure at the inlet of the venturi, for example at the inlet of the port opening 182, in FIG. 8, after the compressor shroud diffuser. The solid line represents a total pressure loss of approximately 0.8 defined as total pressure at the throat of the venturi section divided by the total pressure at the inlet of the venturi, for example at the inlet of the port opening 182 in FIG. 8. In general, the operating range of a venturi is defined by the choke of the venturi, when the corrected mass flow rate per unit throat area becomes constant, and when the pressure at the venturi throat is equal to the pressure, for example, at the compressor inlet.

Figure 11:
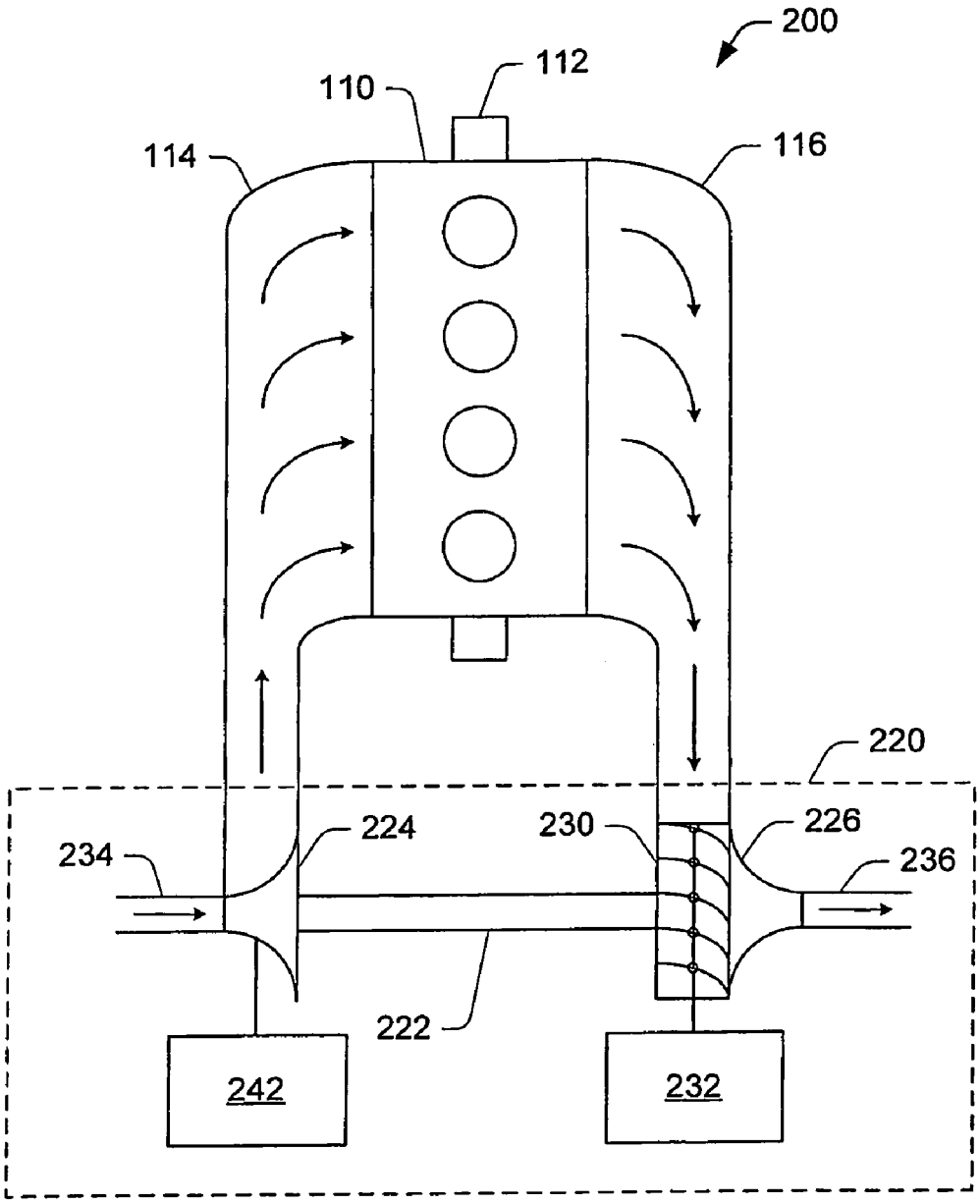
FIG. 11 is an exemplary system that includes one or more actuators or controllers wherein at least one actuator or controller can adjust a valve for control of re-circulation gas.

FIG. 11 shows an exemplary system 200, including an exemplary internal combustion engine 110 (see, e.g., the engine 110 of FIG. 1) and an exemplary turbocharger 220. The exemplary turbocharger 220 includes a air inlet 234, a shaft 222, a compressor 224, a turbine 226, a variable geometry unit 230, a variable geometry actuator or controller 232, an exhaust outlet 236, and a port valve actuator or controller 242. In this example, the compressor 224 includes an exemplary port that allows for re-circulation (e.g., a port having features of one or more of the ports 180, 480, 580, 680, 780, etc.). The variable geometry unit 230 and/or variable geometry actuator 232 optionally has features such as those associated with commercially available variable geometry turbochargers (VGTs), such as, but not limited to, the GARRETT® VNT™ and AVNT™ turbochargers, which use multiple adjustable vanes to control the flow of exhaust through a nozzle and across a turbine. As shown, the variable geometry unit 230 is optionally positioned at, or proximate to, an exhaust inlet to the turbine 226.

The actuators or controllers 232, 242 optionally receive signals from one or more sensors or other controllers. Further, a control scheme may depend on control of one or more port valves and control of geometry.

Figure 12:
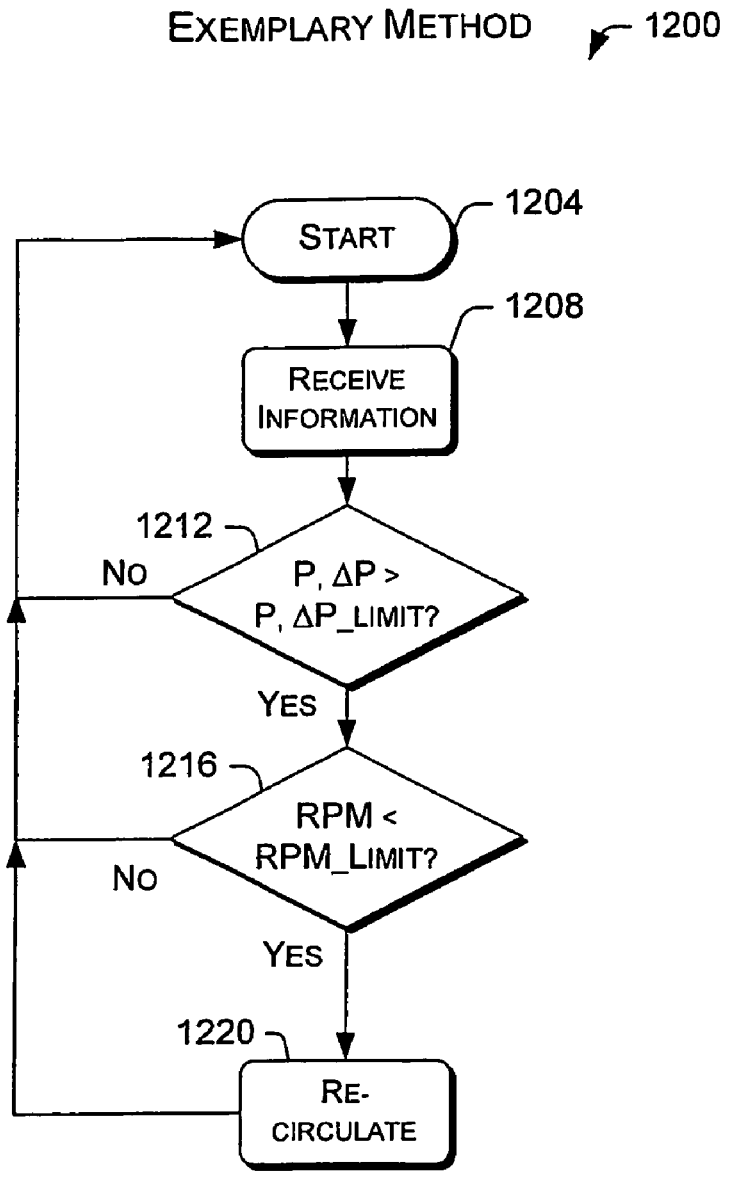
FIG. 12 is a block diagram of an exemplary method for adjusting flow of re-circulation gas.

FIG. 12 shows a block diagram of an exemplary control scheme 1200. The exemplary method 1200 commences in a start block 1204. Next, in a reception block 1208, a controller receives information regarding one or more conditions. A decision block 1212 follows wherein control logic is used to decide how one or more pressures compare with one or more pressure limits. For example, if the back pressure meets or exceeds some pressure limit and/or causes a certain pressure differential to meet or exceed some pressure differential limit, then there may be a risk of approaching or exceeding a surge limit. While control of an exemplary port having one or more valves may occur at this point, the exemplary method 1200 includes an additional decision block 1216. According to the exemplary method 1200, the decision block 1216 compares compressor wheel rotational speed or inertia to a speed or inertia limit. Such a decision block 1216 may assess risk of surge based on speed or inertia wherein a higher speed or a higher inertia generally indicates a lower risk of surge. Hence, if the decision block 1212 and the decision block 1216 indicate that a risk of surge exists, then appropriate control occurs in a control block 1220 that controls one or more valves of an exemplary port.

Such an exemplary method is optionally implemented at least partially in software. For example, one or more computer-readable media having computer-readable instructions thereon which, when executed by a programmable device (e.g., a controller), may adjust one or more valves to control re-circulation of gas from a first port opening positioned at a location downstream from a compressor wheel and from a second port opening positioned at a location radially adjacent to a blade of the compressor wheel to a third port opening positioned at a location upstream from the compressor wheel. As described herein, the adjusting may be based at least in part on information received from one or more sensors. Such information may include pressure information, temperature information, compressor wheel rotational speed information, compressor wheel inertia information, and compressor air mass flow rate.

Another exemplary method may include providing a compressor wheel with power from an exhaust turbine, compressing gas using the compressor wheel, and re-circulating a portion of the gas from a location downstream from the compressor wheel, through a venturi, and to a location upstream from the compressor wheel. Such an exemplary method may also include re-circulating an additional portion of the gas from a location radially adjacent to a blade of the compressor wheel to the location upstream from the compressor wheel. Further, the portion and the additional portion of the gas optionally meet at a confluence prior to the location upstream from the compressor wheel.

The aforementioned exemplary method optionally includes adjusting a valve positioned between the location downstream from the compressor wheel and the location upstream from the compressor wheel to control the re-circulating and/or adjusting a valve positioned between the location radially adjacent to the compressor wheel and the confluence to control the re-circulating.

Although some exemplary methods, devices and systems have been illustrated in the accompanying Drawings and described in the foregoing Detailed Description, it will be understood that the methods and systems are not limited to the exemplary embodiments disclosed, but are capable of numerous rearrangements, modifications and substitutions without departing from the spirit set forth and defined by the following claims.

What is claimed is:

1. A compressor housing comprising:

a first port opening positioned at a location downstream from a compressor wheel;

a second port opening positioned at a location adjacent to a blade of the compressor wheel; and a third port opening positioned at a location upstream from the compressor wheel wherein the first port opening and the third port opening define a first flow path and wherein a second flow path extending from the second port opening meets the first flow path at a confluence, wherein the first flow path comprises a venturi section, wherein the confluence coincides with the venturi section and wherein the venturi section comprises a cross-sectional area less than a cross-sectional area of a portion of the first flow path located between the venturi section and the first port opening.

2. The compressor housing of claim 1, further comprising one or more valves positioned to control flow along one or more of the first flow path and second flow path.

3. The compressor housing of claim 1, wherein the second flow path forms an angle of greater than 90° with respect to the first flow path at the confluence, wherein 0° corresponds approximately to an intended direction of flow along the first flow path and wherein the angle is measured counter-clockwise from 0°.

4. A port comprising:

a first port opening positioned at a location downstream from a compressor wheel;

a second port opening positioned at a location adjacent to a blade of the compressor wheel; and a third port opening positioned at a location upstream from the compressor wheel wherein the first port opening and the third port opening define a first flow path and wherein a second flow path extending from the second port opening meets the first flow path at a confluence, wherein the first flow path comprises a venturi section and wherein the confluence coincides with the venturi section.

5. The port of claim 4, further comprising one or more valves positioned to control flow along one or more of the first flow path and second flow path.

6. A method comprising:

providing a compressor wheel with power from an exhaust turbine;

compressing gas using the compressor wheel;

re-circulating a portion of the gas from a location downstream from the compressor wheel, through a venturi, and to a location upstream from the compressor wheel; and re-circulating an additional portion of the gas from a location radially adjacent to a blade of the compressor wheel to the location upstream from the compressor wheel wherein the portion and the additional portion of the gas meet at a confluence at the venturi prior to the location upstream from the compressor wheel.

7. The method of claim 6, further comprising adjusting a valve positioned between the location radially adjacent to the blade of the compressor wheel and the confluence to control the re-circulating.

8. The method of claim 6, further comprising adjusting a valve positioned between the location downstream from the compressor wheel and the location upstream from the compressor wheel to control the re-circulating.

* * * * *